US008959948B2

(12) United States Patent
Armsden et al.

(10) Patent No.: US 8,959,948 B2
(45) Date of Patent: Feb. 24, 2015

(54) RECEIVER DRYER

(75) Inventors: Richard Armsden, Billericay (GB); Dominic Bennett, Billericay (GB); Leo Somhorst, Chiselhurst (GB)

(73) Assignee: Halla Visteon Climate Control Corporation, Daejeon-si (KR)

( * ) Notice: Subject to any disclaimer, the term of this patent is extended or adjusted under 35 U.S.C. 154(b) by 208 days.

(21) Appl. No.: 13/214,378

(22) Filed: Aug. 22, 2011

(65) Prior Publication Data

US 2012/0060546 A1 Mar. 15, 2012

(30) Foreign Application Priority Data

Sep. 10, 2010 (GB) ..... 1015097.7

(51) Int. Cl.
*F25B 43/00* (2006.01)
*F25B 39/04* (2006.01)
*F25B 40/02* (2006.01)

(52) U.S. Cl.
CPC ..... *F25B 43/006* (2013.01); *F25B 40/02* (2013.01); *F25B 2339/0441* (2013.01); *F25B 2400/162* (2013.01)
USPC ..... 62/474; 62/509

(58) Field of Classification Search
USPC ..... 62/474–475, 470, 85
See application file for complete search history.

(56) References Cited

U.S. PATENT DOCUMENTS

| | | | | |
|---|---|---|---|---|
| 4,072,615 | A * | 2/1978 | McConnell | 210/282 |
| 5,992,174 | A | 11/1999 | Mittelstrass | |
| 6,260,379 | B1 * | 7/2001 | Manwill et al. | 62/509 |
| 6,374,632 | B1 * | 4/2002 | Nobuta et al. | 62/509 |
| 6,692,556 | B2 * | 2/2004 | Hayes et al. | 96/147 |
| 6,708,522 | B2 * | 3/2004 | Yamazaki et al. | 62/509 |
| 7,275,390 | B2 * | 10/2007 | Evans et al. | 62/474 |
| 2006/0185385 | A1 * | 8/2006 | Feldhaus et al. | 62/509 |
| 2008/0314252 | A1 * | 12/2008 | Min et al. | 96/151 |
| 2010/0147019 | A1 | 6/2010 | Kaspar et al. | |

FOREIGN PATENT DOCUMENTS

| | | | |
|---|---|---|---|
| EP | 1628106 | A2 | 2/2006 |
| WO | 2006128720 | A1 | 12/2006 |
| WO | WO 2006128720 | A1 * | 12/2006 |
| WO | WO2008104349 | A2 * | 9/2008 |

* cited by examiner

*Primary Examiner* — Cheryl J Tyler
*Assistant Examiner* — Elizabeth Martin
(74) *Attorney, Agent, or Firm* — Fraser Clemens Martin & Miller LLC; James D. Miller

(57) ABSTRACT

A receiver dryer for a motor vehicle air conditioning system includes an elongate housing, the housing having opposite ends and an external wall that extends between the ends, an inlet positioned in a first section of the housing for receiving condensed refrigerant from the condenser unit, an outlet positioned in a second section of the housing for providing dried condensed refrigerant to the condenser unit with a partition dividing the first section from the second section such that the second section is above the first section, a first chamber in the first section containing a desiccant for drying the refrigerant received from the inlet, a second chamber in the second section containing a filter for filtering the dried condensed refrigerant provided to the outlet, and a conduit.

12 Claims, 4 Drawing Sheets

RECEIVER DRYER

CROSS-REFERENCE TO RELATED APPLICATION

The present application claims priority to United Kingdom Patent Application Serial No. 1015097.7 filed Sep. 10, 2010, the entire disclosure of which is hereby incorporated herein by reference.

FIELD OF THE INVENTION

This invention relates to air conditioning systems and in particular to a receiver dryer for a motor vehicle air conditioning system. More specifically, this invention relates to a receiver dryer having an integral duct.

BACKGROUND OF THE INVENTION

Most modern vehicles include an air conditioning system which comprises a number of components including a compressor, condenser, receiver dryer, expansion valve and evaporator. The air conditioning system also includes a refrigerant or coolant that flows through each of the components in turn, and undergoes repeated phase changes from a liquid to a gas and back to a liquid.

When the air conditioning system in a vehicle is switched on, liquid refrigerant under pressure flows from the receiver dryer to the expansion valve. Here, the refrigerant expands to form a gas, and as it does so, the temperature of the refrigerant drops. The cool gas then enters the evaporator where it absorbs heat from the air that is flowing into the passenger compartment of the vehicle, causing the refrigerant to boil.

The low-pressure refrigerant vapor then enters the compressor. The compressor is typically driven by a drive belt connected to the engine's crankshaft. The compressor compresses the refrigerant vapor and pumps it as a high pressure gas to the condenser. The condenser is typically mounted in front of a vehicle's radiator and comprises a large number of cooling fins surrounding parallel tubes. As the refrigerant flows through the tubes, air flowing past the fins of the condenser removes heat from the refrigerant, and the refrigerant changes from a gas to a liquid.

The liquid refrigerant then enters the receiver dryer (also called a modulator). The primary function of the receiver dryer is to separate any remaining gas from the liquid refrigerant. The receiver dryer is also used to remove moisture from the refrigerant, and therefore, will typically include a chemical desiccant to remove water from the refrigerant so that it does not freeze in the expansion section of the system. The receiver dryer may further include a filter to remove any dirt from the liquid.

In some vehicle air conditioning systems, a sub-cooled section is located between the receiver dryer and the expansion valve. This sub-cooled section provides additional cooling for the condensed refrigerant to improve system efficiency.

Due to the multiple functions of the receiver dryer, this component is typically complex, and often incorporates a removable insert to allow the desiccant and/or the filter element to be replaced at intervals. The receiver dryer may also include multiple conduits to direct the flow of refrigerant.

It is an object of the present invention to provide a less complex receiver dryer.

SUMMARY OF THE INVENTION

According to a first aspect of the invention, there is provided a receiver dryer for an air conditioning system for use with a condenser unit having a lower condenser section and an upper super-cooling section, the receiver dryer comprising: an elongate housing, said housing having opposite ends and an external wall that extends between said ends; an inlet positioned in a first section of the housing for receiving condensed refrigerant from said lower condenser section of a condenser unit; an outlet positioned in a second section of the housing for providing dried condensed refrigerant to said upper super-cooling section of a condenser unit; a partition dividing the first section from the second section such that, in use, the second section is above the first section; a first chamber in said first section containing a desiccant for drying the refrigerant received from the inlet; a second chamber in said second section containing a filter for filtering said dried condensed refrigerant provided to the outlet; a conduit, the conduit having a conduit inlet inside the first chamber for receiving said condensed refrigerant from the first chamber and a conduit outlet inside the second chamber for conveying said received condensed refrigerant upwards past the partition from the first chamber into the second chamber; wherein the housing has within the external wall an internal wall, the internal wall having an elongate central portion extending in the same direction as the external wall, the central portion being bounded on opposite sides by flanks joined to the external wall, and said central portion being spaced apart from the external wall, said spacing providing on one side of the internal wall said conduit and on the other side of the internal wall the first chamber containing the desiccant.

Typically, for ease of manufacture, the internal wall and external wall are a unitary component.

In some embodiments, the internal wall is elongate in the same direction as the housing is elongate.

The internal wall may have a first lip, a spacing between said first lip and the external wall defining the conduit inlet, and in some embodiments, the internal wall additionally has a second lip, a spacing between said second lip and the external wall defining the conduit outlet.

The internal wall may also have a location feature, the position of the partition being determined by the location feature. The location feature may be an end of the internal wall.

In other embodiments, the partition comprises a disc, an edge of said disc being located by the location feature.

The spacing between the internal wall and the external wall that forms the conduit is arcuate and the spacing between the internal wall and the external wall that forms the first chamber is circular.

Advantageously, one end of the housing has a removable lid for gaining access to the second section in order to replace the filter, and the partition is removable from the housing in order to replace the desiccant.

Also, according to a second aspect of the invention, there is provided an air conditioning condenser system comprising a condenser unit for condensing said refrigerant and a receiver dryer for drying said condensed refrigerant, the condenser unit having a condensing section and a sub-cooling section, the sub-cooled section being positioned above the condensing section, the condenser section having a condenser section outlet positioned in a lower portion of the condenser unit and the receiver dryer having a receiver dryer inlet positioned in a lower portion of the receiver dryer for receiving condensed refrigerant from the condenser section outlet, and the sub-cooled section having a sub-cooled section inlet positioned in an upper portion of the condenser unit and the receiver dryer having a receiver dryer outlet positioned in an upper portion of the receiver dryer for providing condensed and dried refrigerant to the sub-cooled section inlet, wherein the receiver dryer is according to the first aspect of the invention.

BRIEF DESCRIPTION OF THE DRAWINGS

The invention will now be further described, by way of example only, and with reference to the accompanying drawings, in which.

DETAILED DESCRIPTION OF EXEMPLARY EMBODIMENTS OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
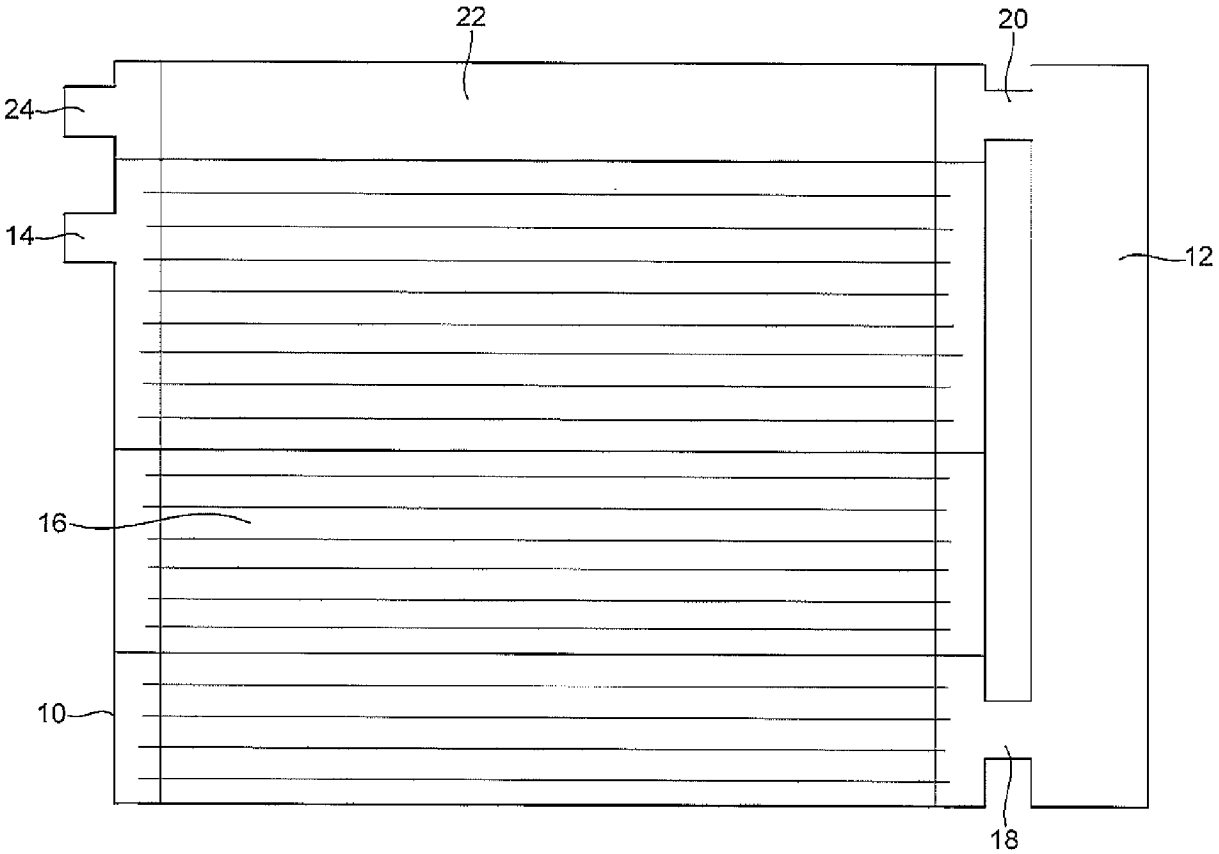
FIG. 1 is a schematic representation of a condenser of an air conditioning unit with a receiver dryer unit attached.

FIG. 1 shows a condenser unit 10 and receiver dryer 12 which typically form part of an air conditioning system of a motor vehicle. Refrigerant enters the condenser 10 through an inlet 14 towards the top of the unit 10. The refrigerant flows through a series of interconnected tubes (not shown) in the main body 16 of the condenser unit 10. As the refrigerant flows, it is cooled by a flow of air around the tubes. Usually, the condenser unit 10 also comprises a plurality of metal fins (not shown) that aid in the cooling process. For example, the condenser unit 10 may be a multipass-type heat exchanger of an aluminium tube and aluminium fin construction.

Liquid refrigerant then flows out of the condenser unit 10 through an outlet 18 and into the receiver dryer 12. In this example, the receiver dryer 12 is shown as a separate assembly. However, in some systems, the receiver dryer 12 is integral with the condenser unit 10. After being dried and filtered, the refrigerant flows out of the receiver dryer 12 through an inlet 20 to a sub-cooled, or super-cooled, section 22.

The sub-cooled section 22 provides additional cooling for the refrigerant to improve the operation and efficiency of the air conditioning system, and it is desirable to have the sub-cooled section 22 located above the main body 16 of the condenser 10.

The refrigerant then exits the sub-cooled section 22 through an outlet 24 and passes to the next stage of the air conditioning system.

In traditional receiver dryers for air conditioning systems not having a sub-cooled section, or for systems in which the sub-cooled section is located at the bottom of the condenser, the liquid refrigerant is directed to flow down through a desiccant housed within a portion of the receiver dryer unit. The refrigerant may also flow through a filter either before or after flowing through the desiccant and the refrigerant then exits the receiver dryer at the base of the unit. However, with a sub-cooled section 22 located at the top of the condenser, it is typically necessary for the refrigerant to exit from the receiver dryer 12 at or near the top of the unit.

Figure 2:
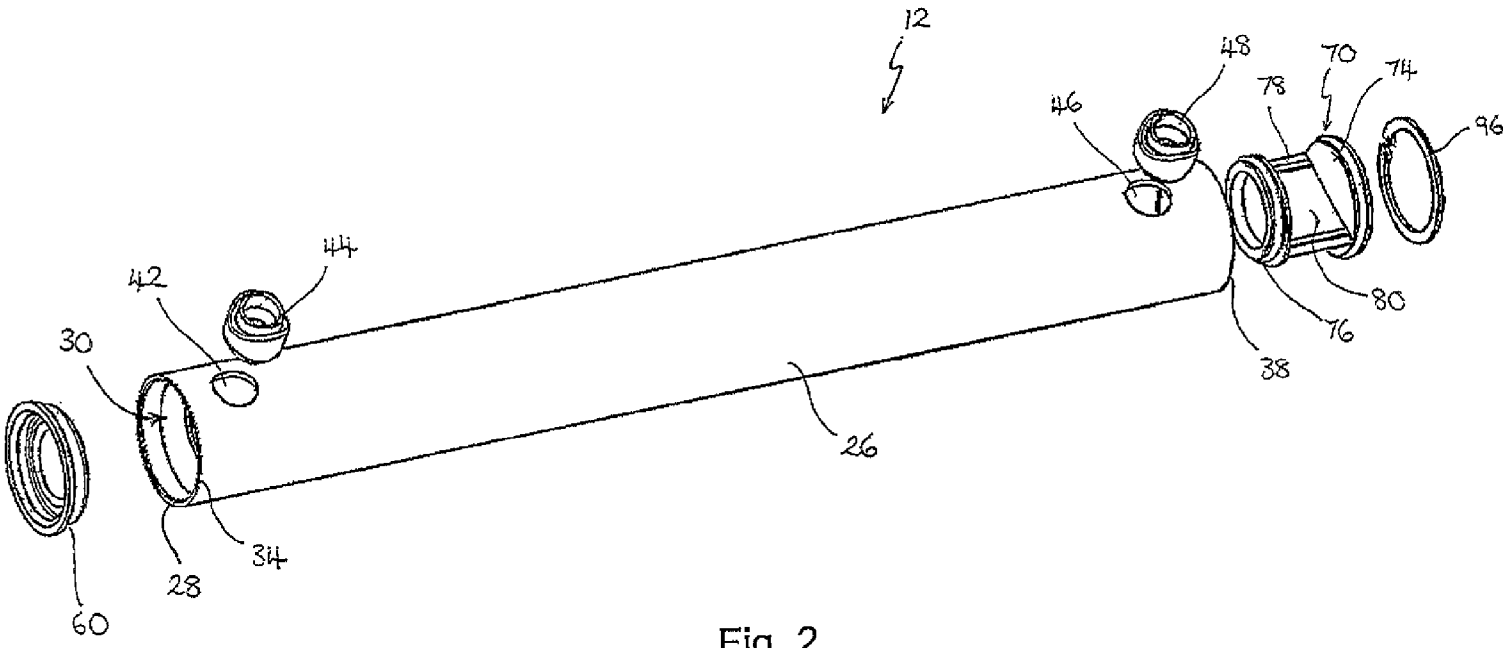
FIG. 2 is an exploded perspective view of a receiver dryer unit according to an embodiment of the invention.
Figure 3:
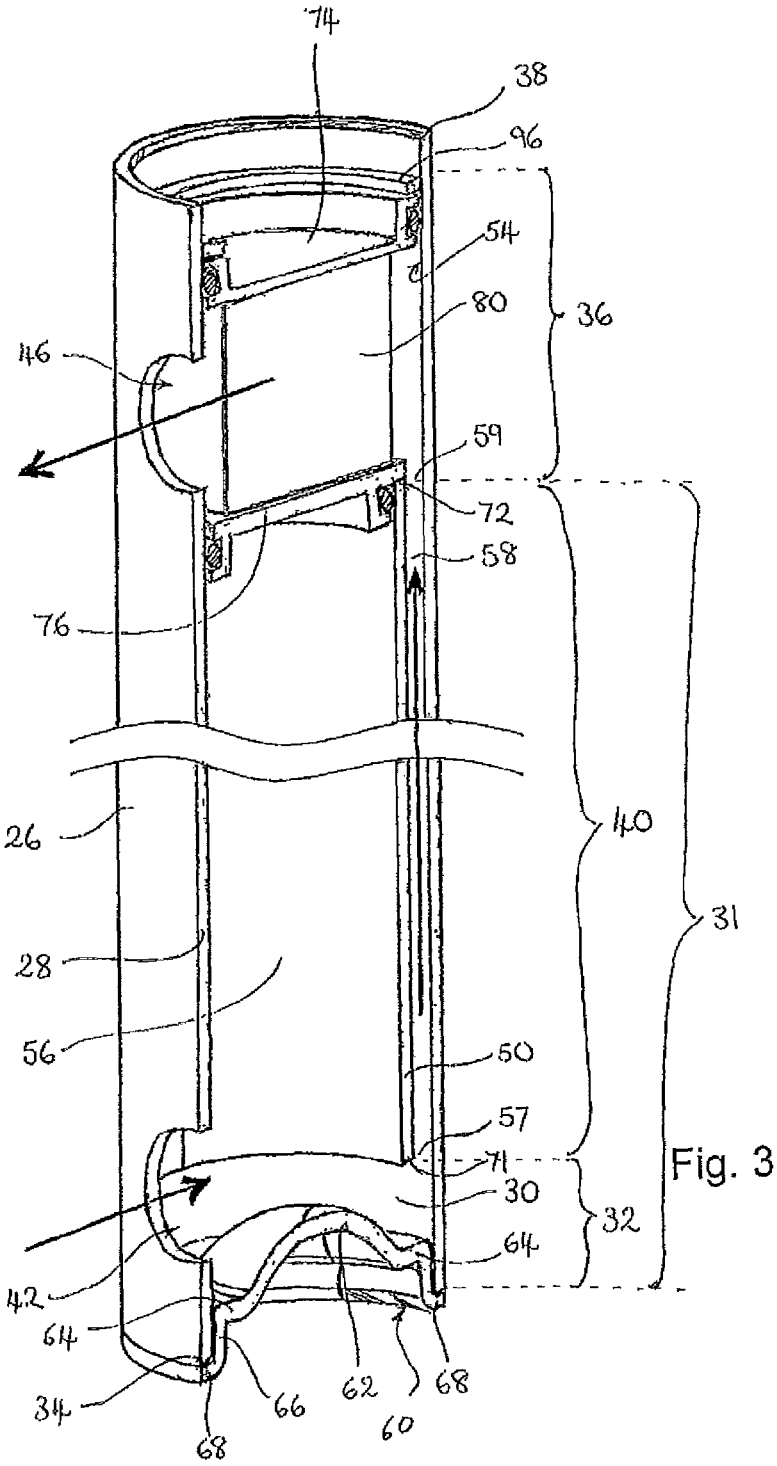
FIG. 3 is a sectional view showing the interior of the receiver dryer unit of FIG. 2.

FIGS. 2 and 3 illustrate the receiver dryer unit 12 according to the present invention.

A body or housing 26 of the receiver dryer 12 is formed from a hollow elongate tubular member such that an external wall 28 of the receiver dryer is cylindrical. In this embodiment, the receiver dryer housing 26 has a circular cross-sectional shape. However, in other embodiments, the cross-sectional shape may be different. For example, the receiver dryer 12 may have an oval or semi-circular cross-section, or the receiver dryer 12 may have any other suitable cross-sectional shape. The external wall 28 surrounds a substantially hollow core 30 of the receiver dryer 12.

The housing 26 of the receiver dryer 12 is divided into two sections 31, 36 along its length, as shown in FIG. 3. A first section 31 is further divided into two zones, an inlet zone 32 located at a first end 34 of the housing 26 and a central zone 40. A second section comprises an outlet zone or chamber 36 located at a second end 38 of the housing 26. The central zone 40 extends between the inlet and outlet zones 32, 36. The central zone 40 is typically significantly longer than either the inlet zone 32 or the outlet zone 36, for example, the central zone 40 may be between five and ten times longer than the inlet zone 32 or the outlet zone 36, and in this way the central zone 40 extends for most of the length of the receiver dryer housing 26.

An inlet aperture 42 is located in the external wall 28 proximate the first, or lower, end 34 of the receiver dryer housing 26 such that the inlet aperture 42 opens into the inlet zone 32. The inlet aperture 42 is typically circular and is adapted to receive a first end of an inlet conduit 44. The inlet conduit 44 is fixed to the receiver dryer housing 26 using any suitable means, and in some embodiments, the inlet conduit 44 may be integrally formed with the external wall 28. The second end of the inlet conduit 44 attaches to the outlet 18 of the condenser unit 10. The inlet conduit 44 will typically be a rigid tubular member and will be of a suitable length to join the condenser 10 and the receiver dryer 12 in fluid communication.

An outlet aperture 46 and associated outlet conduit 48 are located proximate the second, or upper, end 38 of the receiver dryer housing 26 such that the aperture 46 opens into the outlet zone 36. The outlet aperture 46 and outlet conduit 48 will typically have an identical or a similar construction to the inlet aperture 42 and conduit 44 described above. The second end of the outlet conduit 48 attaches to the inlet 20 of the sub-cooled section 22 of the condenser unit 10.

An internal wall 50 spans the core 30 of the receiver dryer housing 26 between a first point 51 and a second point 52 around an inner surface 54 of the external wall 28. In particular, the internal wall 50 comprises an elongate central portion 53 having first and second ends 71, 72. The central portion 53 is bounded on opposite sides by flanks 55 (shown most clearly in FIG. 6*b*), and the flanks 55 are joined to the external wall 28 at the first and second points 51, 52. The internal wall 50 extends substantially parallel to a longitudinal axis of the receiver dryer 12 and extends for the full length of the central section 40 of the housing 26. The internal wall 50 may be integrally formed with the external wall 28 of the receiver dryer 12. In certain embodiments, the internal wall 50 and the external wall 28 are a unitary extrusion, and more particularly may be co-extruded in an aluminium material.

The internal wall 50 may be formed together with the external wall 28 within an extrusion die (not shown) as a unitary component in an aluminium material.

The internal wall 50 divides the hollow core 30 of the receiver dryer 12 into first and second passageways or compartments 56, 58. The first compartment 56 forms a first storage chamber 56 for receiving a desiccant (not shown) and excess refrigerant, and the second passageway 58 forms a conduit 58, the function of which will be described later.

The first end 71 of the internal wall 50 defines a first end or inlet 57 of the conduit 58 and is located in the first section 31 of the receiver dryer 12. The inlet 57 of the conduit 58 is, therefore, in fluid communication with the inlet zone 32. The second end 72 of the internal wall 50 defines a second end or outlet 59 of the conduit 58 and is located in the second section 36 of the receiver dryer 12. The outlet 59 of the conduit 58 is, therefore, in fluid communication with the outlet zone 36. The first and second ends 71, 72 of the internal wall 50 may include a lip feature.

The internal volume of the conduit or transport tube 58 is equal to or less than the volume of the storage chamber 56. However, the internal volume of the conduit 58 may be significantly less than that of the storage chamber 56.

Figure 4:
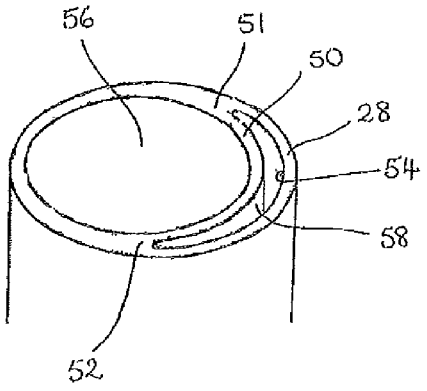
FIG. 4 shows an arrangement and shape of the integral conduit of the receiver dryer unit of FIG. 3.
Figure 6A:
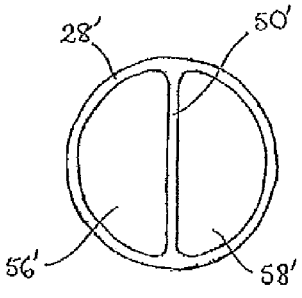
FIGS. 6*a* to 6*c* show various alternative cross-sectional shapes of a desiccant chamber and the conduit of the receiver dryer unit of the present invention.
Figure 6B:
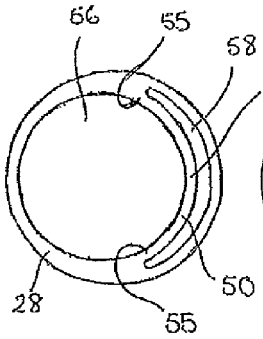

As shown in FIG. 4, and also in FIG. 6*b*, the internal wall 50 is curved such that the conduit 58 has a crescent-shaped or arcuate cross-sectional geometry. In this way, the storage chamber 56 retains a circular cross-sectional shape within the housing 26 of the receiver dryer 12, with the conduit 58 extending around a part of the circumference of the storage chamber 56. The functions of the storage chamber 56 and the conduit 58 will be described in more detail later.

The base of the receiver dryer 12 is formed by a stamped cap 60 that is attached to the bottom edge 34 of the receiver dryer housing 26 such as by a brazing process, for example. The cap 60 includes a central domed region 62 with a flange portion 64 extending radially outwards. A circular side wall 66 extends substantially perpendicularly from the edge of the flange 64 so that the wall 66 projects from the flange 64 in a direction opposite to the projection of the domed region 62, and the side wall 66 includes a lip 68 that extends radially outwards from the edge of the wall 66 furthest from the flange 64. The dimensions of the cap 60 are such that an outer diameter of the side wall 66 is equal to the inner diameter of the external wall 28 of the receiver dryer housing 26. The cap 60 can, therefore, be pushed onto the end of the housing 26 so that the domed region 62 projects into the inlet zone 32 of the receiver dryer 12, and the lip 68 abuts the bottom edge 34 of the tubular external wall 28.

Although the base cap 60 is shown as dome-shaped in this embodiment, the cap 60 may be of any suitable shape so as to withstand the pressure within the receiver dryer 12, which is typically around 20 bar (2000 kPa).

Figure 5:
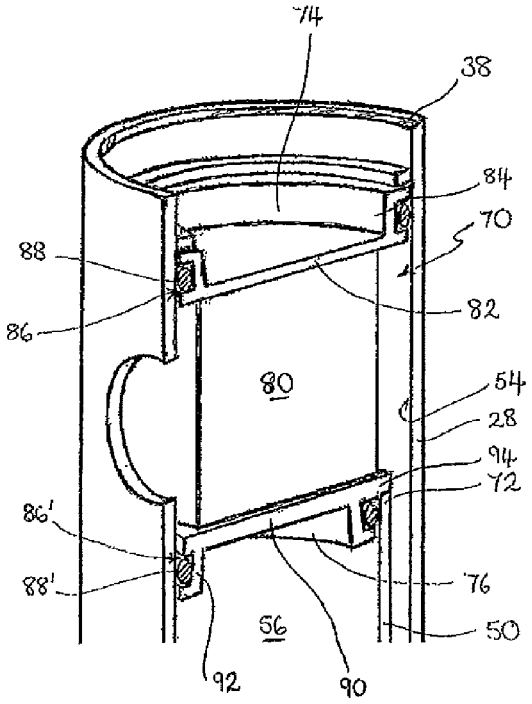
FIG. 5 is an enlarged fragmentary sectional view of the filter plug assembly of the receiver dryer unit of FIG. 3.

A filter plug assembly 70 is used to seal the second, upper end 38 of the receiver dryer housing 26 as well as an upper end of the storage chamber 56, as shown most clearly in FIG. 5. The filter plug assembly 70 comprises first and second capping members 74, 76 and a filter housing 78 (FIG. 2) extending between the first and second capping members 74, 76 and supporting a filter 80.

The first capping member 74 comprises a circular, disc-shaped plate 82 and a flange 84 extending around the periphery of the plate 82 and projecting perpendicularly from the plate 82. A circumferential groove or channel 86 is formed in the outer surface of the flange 84. The channel 86 is sized to house an O-ring 88 such that part of the O-ring 88 projects from the surface of the flange 84. As such, the O-ring forms an upper sealing means 88 of the filter plug assembly 70.

The second capping member 76 also comprises a circular, disc-shaped plate 90. A circular wall 92 projects perpendicularly from one face of the plate 90. The circular wall 92 has a smaller diameter than the plate 90 and the wall 92 is positioned such that the centers of the two circles are offset and the outer face of the wall 92 is aligned with the edge of the plate 90 around a portion of its length. As such, a portion of the plate 90 extends beyond the wall 92 and forms a crescent-shaped lip 94. A channel 86' is formed in the outer surface of the wall 92. This channel 86' is similar to the channel 86 described above, and is sized to house a second O-ring 88' so as to form a lower sealing means 88' of the filter plug assembly 70.

In the filter plug assembly 70, the capping members 74, 76 are arranged at opposing ends such that the plates 82, 90 lie parallel but spaced apart from each other, and the flange 84 and the wall 92 extend in opposite directions and away from each other. The filter 80 is sandwiched between the plates 82, 90. The filter may be of any type or construction as is well known in the art. It may be desirable, in some embodiments of the invention, to support the filter 80 in the filter housing 78. The filter housing 78 may be in the form of a frame or a cage or similar that supports and retains the filter 80 between the plates 82, 90.

The diameter of the second capping member 76 is less than the diameter of the first capping member 74. In particular, the outer diameter of the first capping member 74 is approximately equal to the inner diameter of the cylindrical external wall 28 of the receiver dryer housing 26, and the outer diameter of the wall 92 of the second capping member 76 is approximately equal to the inner diameter of the storage chamber 56.

As such, when the filter plug assembly 70 is pushed into the second end 38 of the receiver dryer housing 26, the upper sealing means 88 of the first capping member 74 forms a seal against the inner surface of the external wall 28 of the receiver dryer 12. Additionally, the wall 92 of the second capping member 76 extends into an end portion of the storage chamber 56 and the lower sealing means 88' forms a seal against the inner surface of the storage chamber 56. As such, the second capping member 76 forms a partition between the first and second sections 31, 36 of the receiver dryer 12, and in particular between the storage chamber 56 and the outlet zone 36. When the filter plug assembly 70 is fully inserted into the receiver dryer 12, the lip 94 of the plate 90 is seated on the second end 72 of the internal wall 50, and as such, the second end 72 of the wall 50 acts as a location feature for the second capping member 76.

To retain the filter plug assembly 70 in position, a retaining means 96 is inserted in the end 38 of the receiver dryer housing 26. In this embodiment, the retaining means is a C-clip 96 that locates on the edge of the flange 84. The C-clip 96 is outwardly biased so that the C-clip 96 presses against the inner surface of the wall 28 of the receiver dryer 12. In some embodiments it may be preferable to provide a groove or recess in the surface of the wall 28 such that a portion of the retaining means 96 locates in the groove.

In use, before the filter plug assembly has been inserted, the storage chamber 56 is filled with a desiccant material (not shown). Because the bottom of the storage chamber 56 is open, the desiccant material will at least partially fill the inlet zone 32 of the receiver dryer 12. Some desiccant material may also pass into the lower end of the conduit 58. However, if filled in this way, the majority of the conduit 58 should remain free of desiccant material. Once the storage chamber 56 has been filled, the filter plug assembly 70 can be inserted as described above.

The receiver dryer 12 can be assembly to the main condenser unit 10 without the plastic cap (with o-rings) and without the desiccant inside. This is brazed in a furnace, and afterwards the desiccant bag is loaded into the receiver dryer 12 and then the plastic filter plug assembled.

In operation, refrigerant flows from a lower portion of the condenser 10 into the inlet zone 32 of the receiver dryer 12. Upon entering the receiver dryer 12, the refrigerant comes into contact with at least a portion of the desiccant held within the storage chamber 56 and inlet zone 32, which acts to remove water from the refrigerant. The liquid refrigerant then enters the conduit 58 via the inlet 57 and is forced to flow up the conduit 58 due to the pressure in the system. The conduit 58 is straight and unobstructed by any features within the conduit so that the flow of refrigerant is continuous and uninterrupted for the full length of the conduit. At the top or outlet 59 of the conduit 58, the refrigerant enters the outlet zone 36 and passes through the filter 80 held between the first and second capping members 74, 76. The filter removes any debris in the refrigerant before the liquid flows out of the receiver dryer through the aperture 46 and into the sub-cooled section 22 of the condenser unit 10.

Any excess refrigerant in the system is held within the storage chamber 56 of the receiver dryer 12. In this way, the storage chamber 56 is typically at least partially filled with refrigerant in addition to the desiccant material.

In some embodiments, the filter plug assembly 70 may be separable such that each of the first capping member 74, filter housing 78 and second capping member 76 can be separated. This allows the first capping member 74 and the filter housing 78 to be withdrawn from the housing 26 of the receiver dryer 12 when it is necessary to replace or clean the filter 80, with the second capping member 76 remaining in position as a partition. The second capping member 76 may additionally be removed when it is necessary to replace the desiccant within the storage chamber 56.

Figure 6C:
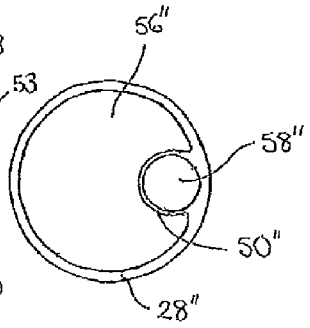

In one embodiment, the receiver dryer 12 includes the cylindrical storage chamber 56 and the arcuate conduit 58 located to one side of the storage chamber 56. In other embodiments it may be preferable if the storage chamber 56 and conduit 58 have different cross-sectional shapes. Two examples are shown in FIGS. 6*a* and 6*c* (FIG. 6*b* is a view of the previously described embodiment for comparison).

In the example shown in FIG. 6*a*, the storage chamber 56' has approximately the same cross-sectional area as the conduit 58'. In this case the internal wall 50' spans the housing of the receiver dryer across the diameter so as to form two semi-circular passageways. In FIG. 6*c*, the conduit 58" has a circular cross-sectional shape and protrudes into a larger storage chamber 56".

In addition, in the embodiment shown in FIGS. 3 and 4, the thickness of the internal 50 and external 28 walls of the receiver dryer 12 are substantially equal. However, in other embodiments, it may be preferable if the internal wall 50 is thinner than the external wall 28, as shown for example in FIG. 6*c*.

The receiver dryer of the present invention has a number of advantages over known devices.

Firstly, because the conduit 58, 58', 58" is integrally formed with the housing 26 of the receiver dryer 12 by co-extrusion of the internal and external walls, the receiver dryer 12 is less complex and has fewer parts then conventional receiver dryers.

Secondly, the co-extrusion process means that it is easy to adapt the relative volumes of the storage chamber 56, 56', 56" and the conduit 58, 58', 58" by changing the shape of the extrusion die to alter the location and shape of the internal wall. This allows the receiver dryer 12 to be easily adapted to accommodate different volumes and flow rates of refrigerant, depending on the system requirements.

The provision of the removable filter plug assembly 70 allows the filter 80 to be removed and replaced easily, during regular servicing of the air conditioning system, without the need to drain the system or fully detach the receiver dryer 12 from the condenser unit 10.

The invention therefore provides an improved receiver dryer for use in an air conditioning system.

From the foregoing description, one ordinarily skilled in the art can easily ascertain the essential characteristics of this invention and, without departing from the spirit and scope thereof, make various changes and modifications to the invention to adapt it to various usages and conditions.

What is claimed is:

1. A receiver dryer for an air conditioning system for use with a condenser unit having a lower condenser section and an upper cooling section, the receiver dryer comprising:

an elongated housing, the housing having a first end, a second end, and an external wall that extends between the first end and the second end;

an inlet positioned in a first section of the housing configured to receive condensed refrigerant from the lower condenser section of the condenser unit;

an outlet positioned in a second section of the housing configured to provide dried condensed refrigerant to the upper cooling section of the condenser unit;

a first chamber in the first section containing a desiccant for drying the condensed refrigerant received by the inlet;

a second chamber in the second section containing a filter for filtering the dried condensed refrigerant provided to the outlet;

a partition dividing the first section from the second section and forming a boundary between the first chamber and the second chamber, wherein the second section is above the first section; and an internal wall disposed within the housing cooperating with the external wall to form the first chamber on a first side of the internal wall and a spacing on a second side of the internal wall, wherein lateral ends of the internal wall are connected to an inner surface of the housing to form a single body, wherein the spacing defines a conduit for the dried condensed refrigerant having an inlet in direct fluid communication with the first chamber for receiving the dried condensed refrigerant from the first chamber and an outlet in direct fluid communication with the second chamber for conveying the dried condensed refrigerant upwards past the partition to the second chamber.

2. The receiver dryer according to claim 1, wherein the internal wall and the external wall are a unitary extrusion.

3. The receiver dryer according to claim 1, wherein the internal wall is elongated in a same direction as the housing is elongated.

4. The receiver dryer according to claim 1, wherein the internal wall has a first lip, a spacing between the first lip and the external wall defining the inlet of the conduit.

5. The receiver dryer according to claim 4, wherein the internal wall has a second lip, a spacing between the second lip and the external wall defining the outlet of the conduit.

6. The receiver dryer according to claim 4, wherein the first lip is formed at a first terminal end of the internal wall in a longitudinal direction of the internal wall.

7. The receiver dryer according to claim 5, wherein the second lip is formed at a second terminal end of the internal wall in a longitudinal direction of the internal wall.

8. The receiver dryer according to claim 1, wherein the internal wall has a location feature, a position of the partition being determined by the location feature.

9. The receiver dryer according to claim 8, wherein the location feature is an end of the internal wall.

10. The receiver dryer according to claim 8, wherein the partition includes a disc, an edge of the disc being located by the location feature.

11. The receiver dryer according to claim 1, wherein the spacing between the internal wall and the external wall that forms the conduit has an arcuate cross-sectional shape and a spacing between the internal wall and the external wall that forms the first chamber has a circular cross-sectional shape.

12. The receiver dryer according to claim 1, wherein the second end of the housing has a removable capping member for gaining access to the second section in order to replace the filter, and the partition is removable from the housing in order to replace the desiccant.

* * * * *